US009527330B2

(12) United States Patent
Meineke et al.

(10) Patent No.: US 9,527,330 B2
(45) Date of Patent: Dec. 27, 2016

(54) DEVICE FOR FORMING BOOK CASES

(71) Applicant: Kolbus GmbH & Co. KG, Rahden (DE)

(72) Inventors: Torsten Meineke, Bassum (DE); Bjorn Hoffmann, Lubbecke (DE)

(73) Assignee: Kolbus GmbH & Co. KG, Rahden (DE)

( * ) Notice: Subject to any disclaimer, the term of this patent is extended or adjusted under 35 U.S.C. 154(b) by 10 days.

(21) Appl. No.: 14/665,158

(22) Filed: Mar. 23, 2015

(65) Prior Publication Data

US 2015/0273926 A1 Oct. 1, 2015

(30) Foreign Application Priority Data

Mar. 29, 2014 (DE) ..... 10 2014 004 614

(51) Int. Cl.

| | |
|---|---|
| ***B42C 7/00*** | (2006.01) |
| ***B42C 11/00*** | (2006.01) |
| ***B42C 11/04*** | (2006.01) |
| ***B42C 13/00*** | (2006.01) |

(52) U.S. Cl.

CPC ..... *B42C 11/04* (2013.01); *B42C 7/00* (2013.01); *B42C 7/004* (2013.01); *B42C 7/005* (2013.01); *B42C 11/00* (2013.01); *B42C 13/003* (2013.01)

(58) Field of Classification Search

CPC ..... B42C 7/00; B42C 7/004; B42C 11/00; B42C 13/003

USPC ..... 412/3, 17, 21, 22

See application file for complete search history.

(56) References Cited

U.S. PATENT DOCUMENTS

| | | | | |
|---|---|---|---|---|
| 6,364,590 | B1 * | 4/2002 | Gayoso | B42C 7/005 412/1 |
| 2009/0221411 | A1 | 9/2009 | Endo | |
| 2011/0014011 | A1 * | 1/2011 | Schilling | B42C 7/005 412/3 |
| 2011/0052347 | A1 * | 3/2011 | Schilling | B42C 7/005 412/17 |
| 2011/0123298 | A1 * | 5/2011 | Mueller | B42C 7/005 412/17 |
| 2011/0176890 | A1 * | 7/2011 | Friese | B42C 7/005 412/17 |

FOREIGN PATENT DOCUMENTS

| | | |
|---|---|---|
| EP | 1 350 634 B1 | 5/2007 |
| EP | 2 227 710 A1 | 1/2011 |
| EP | 2 292 443 A1 | 3/2011 |
| EP | 2 325 020 A1 | 5/2011 |

* cited by examiner

*Primary Examiner* — Kyle Grabowski

(74) *Attorney, Agent, or Firm* — Alix, Yale & Ristas, LLP

(57) ABSTRACT

The invention pertains to a device for forming the spine region and/or the adjacent joint areas of a book case prior to casing-in the book block by means of a forming component that lifts the spine region out of the extended starting position relative to rails that hold down the case boards or the joint areas, wherein the forming geometry of the forming component can be varied by means of motor-driven adjustments, and wherein a separate adjusting drive is assigned to each of the elements that can be adjusted relative to the base element and form the book case.

13 Claims, 4 Drawing Sheets

DEVICE FOR FORMING BOOK CASES

BACKGROUND

The present invention pertains to a device for forming the spine region and/or the adjacent joint areas of book cases.

Known book production machines for the mechanized production of books comprise devices for transporting and devices for processing the supplied book blocks, devices for transporting and devices for processing the supplied book cases, as well as devices for joining one respective book block with an assigned book case, which is also referred to as the so-called casing-in process. Book production machines of this type are designed in such a way that the book blocks, the book cases, as well as the books, are always aligned symmetrically to the center plane of the book blocks that divides the book block at half the block thickness. Prior to the casing-in process, the book cases are performed with respect to the desired shape of the spine and the adjacent joint areas. Known devices used for this purpose lift out the spine region of the extended book case relative to a pair of rails that hold down the joint areas of the book case. These rails are realized in the form of flat hold-down rails or in the form of wedge-shaped joint forming rails with rounded forming areas and positioned in dependence on the width of the spine by means of automatic adjusting drives provided for this purpose. With respect to its width and contour, the forming component that lifts out the spine region of the book case corresponds to the spine.

Conventional forming components used for preforming book cases for books with a straight spine essentially consist of a base plate and a pair of parallel rails that are spaced apart from one another in accordance with the spine width. The rails are screwed to the base plate in oblong holes such that the forming component can be adapted to the width of the spine. This is realized by removing the forming component from the device for reasons of accessibility, manually fixing the rails in the desired position and subsequently reinserting the forming component into the device. This means that a significant effort is required for adjusting the device to the desired spine width and that a machine down-time and therefore an interruption of production are required for correcting the adjustment.

In order to simplify this adjustment of the forming component for books with a straight spine, EP 2 325 020 A1 proposes an adjusting mechanism that couples the two rails lifting out the spine region by means of pushers such that they are inevitably adjusted parallel, as well as symmetrical, to the aforementioned center plane of the book blocks. If the book block should not be cased into the book case symmetrically in order to subsequently arrange additional elements such as, e.g., a plastic packaging for compact discs or a so-called jewel case within the book, the book case needs to be displaced transverse to the transport direction between the preforming process and the casing-in process. Due to the joint areas and the preforming process, however, the book case is weakened, in particular, in the direction of the spine width such that the displacement transverse to the transport direction and therefore in the direction of the spine width requires a reduced production speed and represents a source for malfunctions and diminished production quality.

The production of books with a rounded spine requires forming components that not only correspond to the shape of the book to be produced with respect to their width, but also with respect to the curvature of their surface that faces the book case. The large number of different spine widths and curvatures results in a plurality of required forming components and a corresponding set-up effort. In order to reduce the variety of forming components, slight deviations from the ideal shape, particularly with respect to the width, and quality losses caused thereby are frequently accepted.

EP 1 350 634 B1 proposes a forming component for the production of books with a rounded spine, wherein said forming component comprises a closed frame and a plurality of discs that are adjacently arranged in this frame in a height-adjustable fashion. The discs feature individually formed, arc-shaped oblong holes, wherein the entire disc assembly is threaded onto bolts with these oblong holes such that the discs are adjusted to different heights in accordance with the arc shape of the oblong holes by moving these bolts in the longitudinal direction of the forming component and the contour of the forming component can reproduce different radii that are approximated with step profiles. In this case, the quality of the forming surface is decisively influenced by the material thickness of the discs. The disadvantages of this forming component can be seen in the required space for the frame that encloses the disc assembly, as well as the required fixing of the discs with additional means after the adjustment process. Due to the coupled adjustment of the discs, such a forming component also can respectively produce only one contour in dependence on the spine width. Several forming components of this type are required if spines with different curvature radii should be produced for book blocks with the same thickness, wherein these forming components differ with respect to the progression of the grooves in the discs.

SUMMARY

The present invention therefore is based on the objective of making available a device that has a simple construction and makes it possible to preform book cases with spines of different geometries with a high degree of automation.

According to the present disclosure, this objective is attained in that the device for preforming the book case in the spine region and/or the adjacent joint areas is provided with a forming component that comprises a base element and one or more forming elements that can be adjusted relative to this base element, as well as independently adjusted relative to one another, wherein a separate adjusting drive is respectively assigned and connected to each of these forming elements. The advantage attained can be seen in that a single forming component can be configured with a variety of profiles, making it possible to easily produce a much greater variety of spine geometries, particularly with respect to spine width, asymmetry and/or curvature, than known devices, wherein the adjustment takes place in a motor-driven and therefore automated fashion. In this way, the effort required for the set-up and the number of parts to be exchanged can be significantly reduced.

In a general implementation, the device preforms the spine region in a substantially planar delivered book case in which the spine region includes a pair of joint areas that connect to a pair of case boards, with the combination of: (a) a forming component including a base element and at least one additional forming element that is adjustable relative to the base element and together with the base element define a profile of the forming component for preforming the spine region the book case; (b) a main drive for displacing the forming component toward an inner side of the spine region and thereby raising the spine region out of the plane; and (c) an adjusting mechanism or drive that adjusts the additional forming element(s) independently of the first drive and thereby alters the profile of the forming component.

In one embodiment, the forming component comprises in addition to the base element two forming elements in the form of adjustable rails that extend parallel to one another in the longitudinal direction of the spine and lift the spine region out of the book case, wherein said rails are realized such that they can be adjusted essentially perpendicular to the longitudinal orientation of the rails in a plane extending parallel to the extended position of the book case. Although no lateral displacement of the book cases takes place between the case preforming process and the casing-in process, this embodiment still makes it possible to produce books with different spine widths, which are cased in symmetrically as well as asymmetrically, without manual set-up of the case preforming device of a book production machine and, in particular, without requiring the exchange of parts.

In a second embodiment, the forming component comprises in addition to the base element at least one adjustable forming element that can be adjusted relative to the base element perpendicular to the plane defined by the extended book case. In this way, the envelope of the forming component can be adjusted to different curvatures of the book case in an automated fashion.

Contrary to conventional doctrine, book cases with a rounded spine can be produced without quality loss if the spine region of the book case does not rest on the forming component with its entire surface during the case preforming process. In a preferred enhancement of the second embodiment, the forming component therefore comprises regions of the surface enveloped by the spine region of the book case during the spine preforming process which remain spaced apart from the spine region of the book case during the case preforming process. In this way, a forming component that has a simple construction and consists of few components makes it possible to vary the width and the curvature of the spine region independently of one another such that arbitrarily rounded spine regions can be produced without the use of parts to be exchanged.

Each of the forming elements is preferably guided such that it can be adjusted in a parallel fashion by means of levers. This simple design similar to a four-bar linkage allows a compact yet robust construction.

In an alternative embodiment, the adjustment of the forming elements is realized with sliding block guides. This provides the advantage that the sliding blocks can be freely designed and the transmission functions between adjusting drive and adjusting path of each forming element therefore can be optimized, e.g., in order to realize a particularly precise adjustment in frequently used areas.

The adjusting drives for the forming elements advantageously can be controlled by and are connected to the control of the device such that the adjustment of the device can take place in an automated fashion based on available product data. It is furthermore advantageous to realize the adjusting drives in a stationary fashion because this reduces the moving mass and the stress on the electrical line connections of the adjusting drives such that the electrical installation is simplified.

In another advantageous feature, each of the forming elements respectively is permanently connected to and driven by the assigned adjusting drive. In this way, the forming component already can be adjusted to the book case to be formed while the forming component is still in motion, particularly during the return stroke of the forming component into the idle position of the first drive, wherein this is particularly advantageous for minimal production runs. The forming elements can also be fixed by the adjusting drive in this way such that no additional devices, e.g. clamping devices, are required for this purpose and a simple, space-saving and lightweight construction can be achieved.

In order to realize optimum balance between the forming element and the respective adjusting drive during the motion of the forming component, it is proposed to use a roller that runs in an oblong hole during the motion of the forming component. In this way, a highly precise transmission of the motion can be realized with little wear.

If automated control of the adjusting drive is not needed, the advantage of an independent mechanism for adjusting the profile can more simply be achieved with a manually actuated linkage with actuator remote from the base.

BRIEF DESCRIPTION OF THE DRAWING

An exemplary embodiment of the inventive device is described in greater detail below with reference to the drawing, in which.

DETAILED DESCRIPTION

Figure 1:
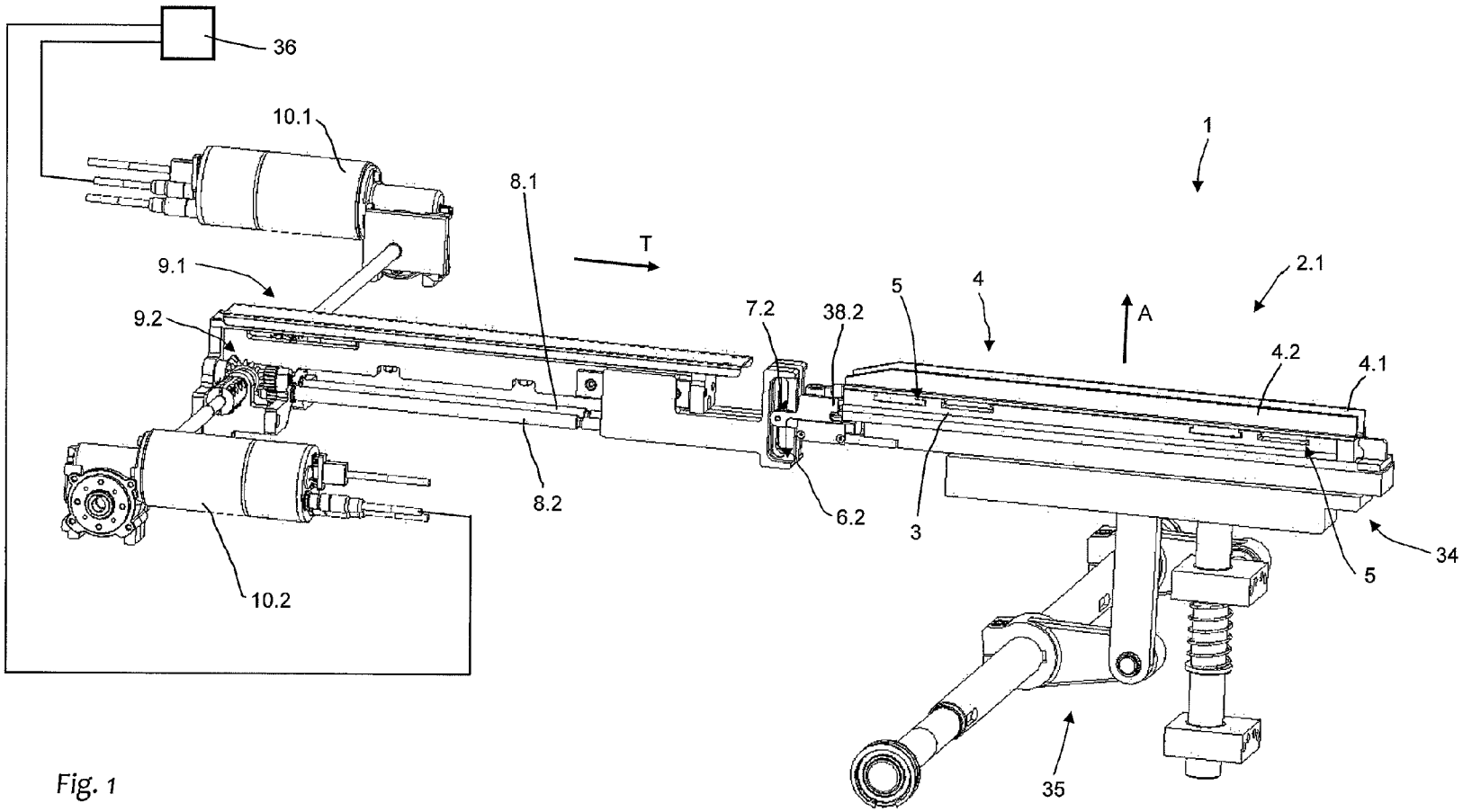
FIG. 1 shows a detail of the device for forming book cases in the form of a perspective representation.
Figure 4:
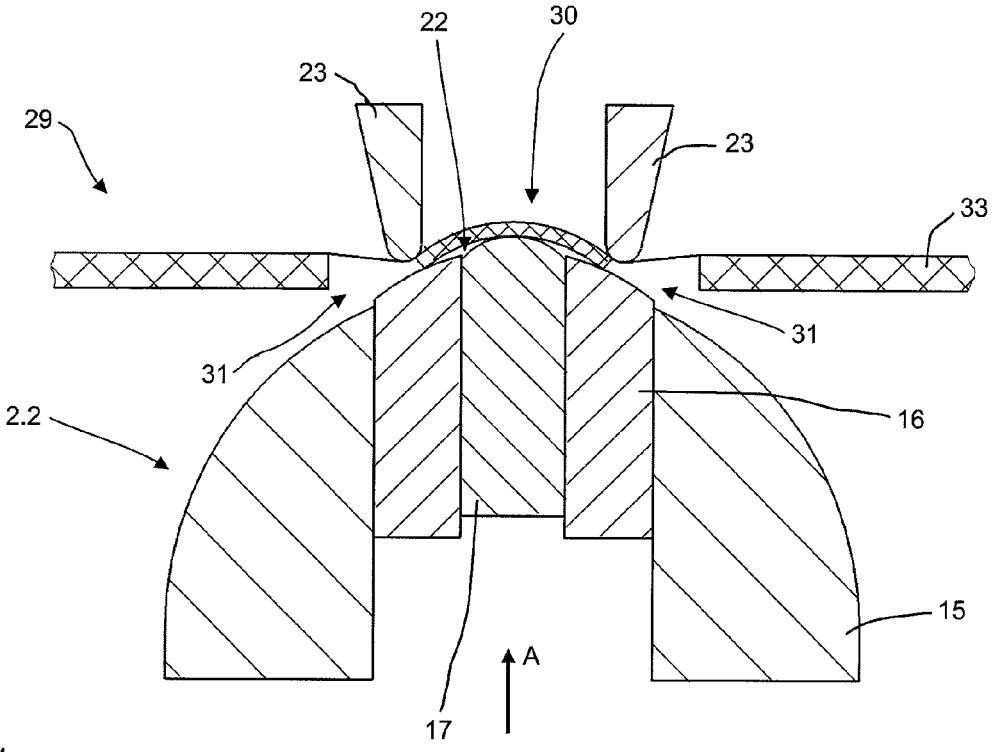
FIG. 4 shows a cross section through a portion of the device while a book case is formed.

The book production machine comprises a transport device for transporting the flat (substantially planar) book cases from a delivery position into a starting position in device 1 for forming the spine region 30 and the adjacent joint areas 31.1 and 31.2 of the book case 29 by lifting the spine region 30 out of the extended planar position in the lift-out direction A, i.e., perpendicular to the plane defined by the book case 29, and for additionally transporting the preformed book case 29 from this device 1 to the location at which it is joined with the book block. FIG. 1 shows the device 1 including a forming component 2.1 for preforming book cases with a straight spine. The forming component 2.1 is fixed in a receptacle 34 with associated first or main drive 35 such that it can be displaced in the lift-out direction A. The receptacle is driven in such a way that the forming component 2.1 is displaced from a lower starting position, in which a rail pair 4 that forms the spine region and consists of the rails 4.1 and 4.2 is initially spaced apart from a book case 29 located in the device 1, then lifted such that it penetrates the plane in which the book case 29 is supported, and thereby lifts the spine region 30 of the book case 29 out of the extended planar position. In order to prevent the entire book case 29 from being lifted, the device 1 selectively comprises a pair of not-shown hold-down rails that are positioned above the case boards 33 in the vicinity of the spine or joint forming rails 23 that are illustrated in FIG. 4 and penetrate into and thereby form the joint areas 31. These hold-down rails or joint forming rails 23 can be adjusted with respect to the spine width of the book case 29 by means of a suitable device that is also not shown, wherein this adjusting device features controllable drives that are connected to the machine control.

Figure 2:
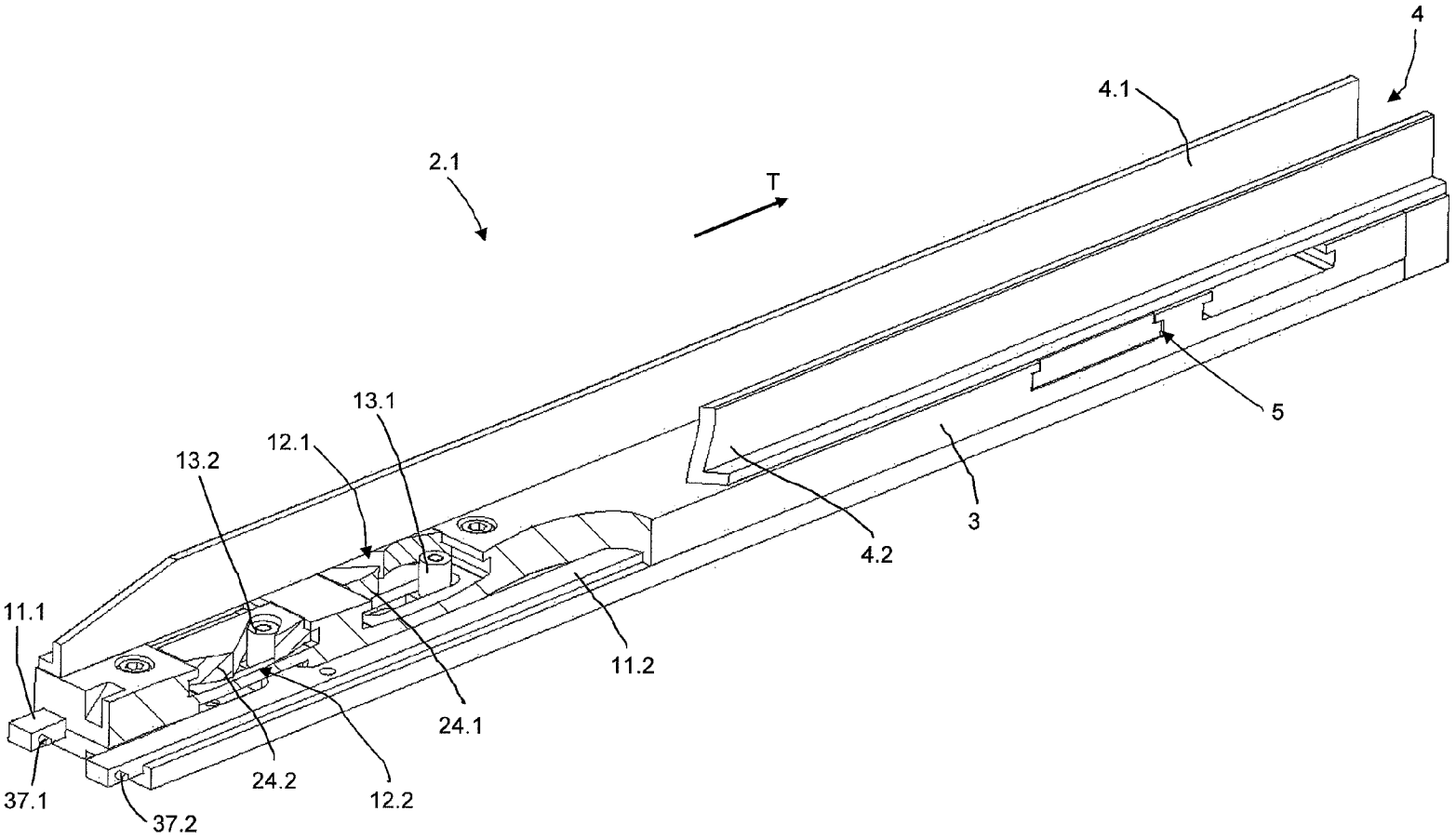
FIG. 2 shows a forming component for book cases with a straight spine region in the form of a perspective representation.

The rails 4.1 and 4.2 extending parallel to one another in the longitudinal direction of the spine region 30 of the book case 29 are respectively supported in the base element 3, with which they form the forming component 2.1, in linear guides 5 such that they can be displaced in the direction of the spine width. The base and rails together define the shape or profile of the portion of the forming component that faces the underside of the spine region (including joint area), but not all of the profile actually contacts the spine region during the forming process. The device 1 respectively features an adjusting unit for each of the two rails 4.1 and 4.2, wherein the adjusting unit contains an adjusting drive 10.1 or 10.2 and a spindle 8 that is connected to and driven by this adjusting drive 10.1 or 10.2 via an angular gear 9. The adjusting drives 10.1 and 10.2 are stationarily arranged independently of the lift-out motion of the forming component 2.1 such that the moving mass during each forming process is maintained small and the electrical installation is simple and only subjected to low mechanical stresses. The spindles 8.1 and 8.2 respectively displace an oblong hole 6 (6.2 shown), which is oriented in the lift-out direction A and in which a roller 7 runs (7.2 shown), in the case transport direction T in order to transmit the displacement of the respective oblong hole 6 to the respective rail 4.1 or 4.2 via additional elements on the one hand and to allow the relative motion within the adjusting unit in the lift-out direction A on the other hand. The rollers 7 are respectively connected to the connecting rods 11.1 and 11.2 illustrated in FIG. 2 via additional elements, wherein pins 37.1 and 37.2 arranged in an upwardly open slots (only 38.2 is visible) respectively makes it possible to easily remove the forming component 2.1 from the device 1 in the upward direction, e.g., such that it can be replaced with a forming component 2.2 for rounded spines described with reference to a second exemplary embodiment shown in FIG. 3.

The adjusting drives 10.1 and 10.2 are connected to control unit 36 of the book production machine in such a way that an automated adjustment based on available production parameters can be realized. In FIG. 1 the numeric ID's 6.1, 6.2, 7.1, 7.2, 8.1, 8.2 and 9.1, 9.2 and in FIG. 2 the ID's 13.1 and 13.2 clarify that drive 10.1 supports rail 4.1 via elements 9.1, 8.1, 6.1, 7.1, 38.1, 37.1, 11.1, 24.1, 13.1 and 12.1 and drive 10.2 supports separate rail element 4.2 in the same way via elements 9.2, 8.2, 6.2, 7.2, 38.2, 37.2, 11.2, 24.2, 13.2 and 12.2. The extensions "0.1" and "0.2" indicate if the element supports rail 4.1 or rail 4.2. Drive 10.1 does not affect rail 4.2 and drive 10.2 does not affect rail 4.1. In the figures, some of the elements with extension "0.1" are hidden by elements with extension "0.2".

Each of the drives 10.1 and 10.2 affects only one of the forming elements 4.1 or 4.2 (FIG. 2) 16 or 17 (FIG. 3) in one orientation (4.1/4.2 in their width, 16/17 in their height). The same drive can control an adjustment in width and height, depending on the mounted forming component. The orientation of the adjustments are given by the sliding blocks 24.1 and 24.2. Both drives 10.1 and 10.2 are connected to the same control unit.

Independent of the actual position or movement of the receptacle 34 with the forming component (2.1, 2.2) driven by the main drive 35, the forming elements (4.1, 4.2, 16, 17) can be adjusted by the drives 10.1, 10.2, while the receptacle is in the fully retracted position, the forming position whereby the forming tool raises the spine region from the plane of the case board and any position in between, remaining in a position, or during movement.

Within the forming component 2.1, the longitudinally directed adjusting motion generated by the spindles 8.1 and 8.2 is converted into the desired adjustment of the rails 4.1 and 4.2 transverse thereto, i.e. in the direction of the width of the spine region 30 of the book case 29, by means of two sliding block guides 12.1 and 12.2 of each rail 4.1 and 4.2. For this purpose, a connecting rod 11.1 or 11.2, on which bolts 13 are arranged, is respectively assigned to each rail 4.1, 4.2, wherein the bolts are respectively guided in oblong holes of the base element 3 that are aligned parallel to the rails 4.1 and 4.2, as well as in non-parallel oblong holes of the slides 24.1 and 24.2 that can be displaced in the width direction. The sliding block guides 12.1 and 12.2 are preferably realized in an arc-shaped fashion such that the transmission ratio changes over the adjusting path and, e.g., the adjustment for narrow spines can be realized more precisely than for wide spines. It would also be possible to use reversing levers as an alternative to the sliding block guides 12.1 and 12.2.

Figure 3:
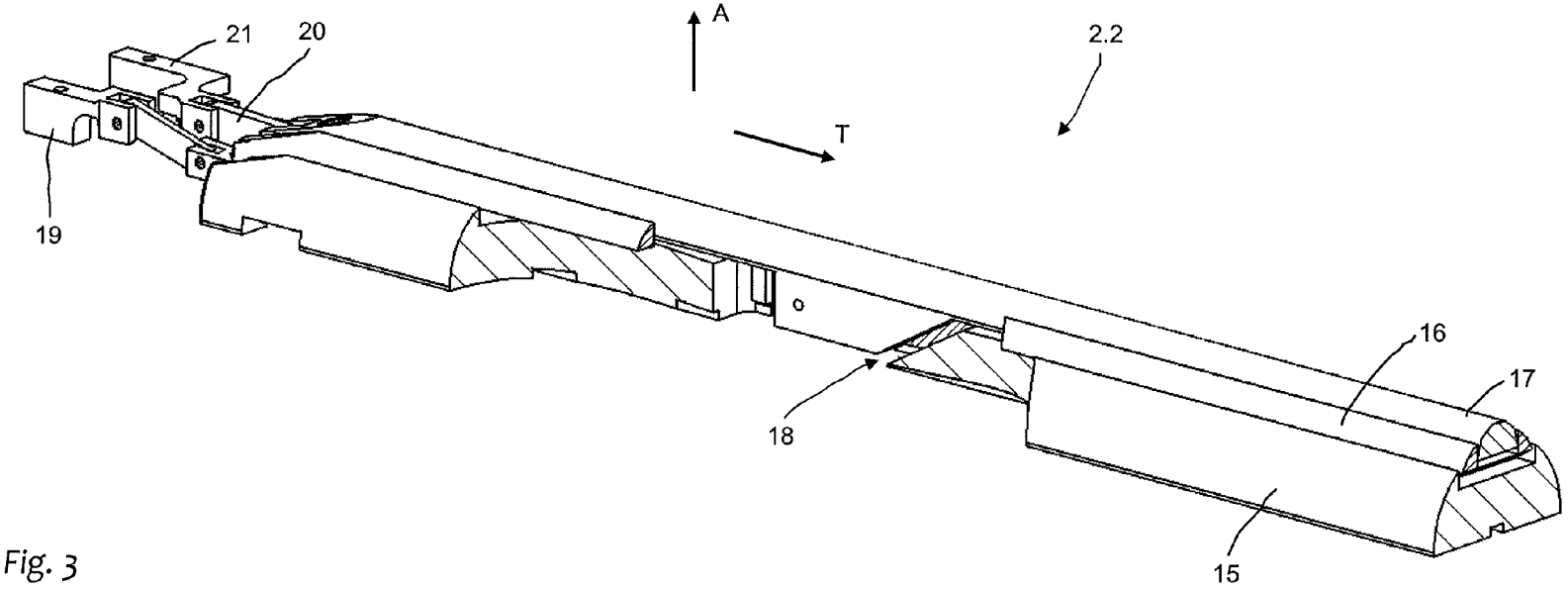
FIG. 3 shows a forming component for book cases with a rounded spine region in the form of a perspective representation.

Instead of the forming component 2.1 for the production of books with a straight spine, an alternative embodiment of the device 1 comprises a forming component 2.2 that is illustrated in FIG. 3 and curves the spine region 30 as it is lifted out of the extended position of the book case 29. In order to produce different formats and contours of the spine region 30 with one tool, the forming component 2.2 comprises several elements that are fitted into one another, wherein the base element 15 simultaneously serves for accommodating the forming component 2.2 in the device 1. A first forming element 16 is displaceably supported in this base element 15 in such a way that the first forming element 16 can be lifted out of the base element 15 in the lift-out direction A. For this purpose, ramp-shaped guides 18 or sliding blocks, which are formed by the base element 15 and the first forming element 16 themselves, are provided such that a relative displacement between the base element 15 and the first forming element 16 in the longitudinal direction T causes a displacement in the lift-out direction A. A second forming element 17 is supported in the first forming element 16 in the same fashion such that the design corresponds to that illustrated in the form of a cross section in FIG. 4 and the base element 15 and the forming elements 16 and 17 can be arbitrarily adjusted relative to one another.

In order to realize their adjustments, the forming element 16 and 17 are respectively coupled to connecting elements 19 and 21 by means of coupling elements 20, wherein the connecting elements are actuated by the adjusting drives 10.1 and 10.2 analogous to the connecting rods 11.1 and 11.2 of the above-described forming component 2.1. In its cross section, each of the forming elements 15, 16 and 17 is convexly curved, e.g., as one or two segments of a circle, such that different contours of the type illustrated in FIG. 4 result independently of the chosen adjustment. In this case, the surfaces of the forming elements 15, 16 and 17 feature areas 22 that remain spaced apart from the spine region 30 of the book case 29 during the forming process. The curvature of the book case 29 above these non-contacting areas 22 results from the material properties of the spine region 30, as well as the distribution of stresses within the spine region 30 that make it possible to support the spine region 30 over part of its surface only.

Both forming components 2.1 and 2.2 are realized in such a way that the interfaces with the receptacle in the device 1 are identical and the forming components 2.1 and 2.2 can be alternately used in the same device.

The invention claimed is:

1. A device for preforming spine regions in planar book cases having a spine region including a pair of joint areas that connect to a pair of case boards, comprising:

a forming component including a base element and at least one additional forming element that is adjustable relative to the base element and together with the base element define a profile of the forming component for preforming the spine region the book case;

a first, main drive for displacing the forming component toward an inner side of the spine region and thereby raising the spine region out of the plane of the book case; and a second, adjusting drive that adjusts said at least one additional forming element independently of the first drive and thereby alters the profile of the forming component;

wherein regions of the profile of the forming component facing the inner side of the spine region remain spaced apart from the spine region during said raising of the spine region from the plane of the book case; and wherein the at least one additional forming element includes a central and two laterally adjacent forming elements, each having convexly curved surfaces that in part define the profile and contact the spine region during forming; and said regions of the profile that remain spaced apart are between the curved surface of the central forming element and the curved surfaces of adjacent forming elements.

2. The device according to claim 1, wherein the spine region has a length and a width and said at least one additional forming element is adjustable in the direction of the spine width along a plane extending parallel to said plane of the book case.

3. The device according to claim 1, wherein the at least one additional forming element is adjustable along a plane extending perpendicular to said plane of the book case.

4. The device according to claim 1, wherein the forming component comprises at least one sliding block that guides the at least one additional forming element.

5. The device according to claim 1, wherein the adjusting drive is stationary with linkage to the at least one additional forming element for adjustment relative to the base element.

6. The device according to claim 5, wherein said linkage comprises at least one roller that is guided by at least one surface.

7. The device according to claim 1, wherein the adjusting drive is motorized and the adjustment of the at least one additional forming element is controlled by a control unit for actuating the adjusting drive.

8. The device according to claim 7, wherein the control unit can actuate the adjusting drive and thereby adjust the additional adjusting element during any position or motion of the main drive.

9. The device according to claim 1, wherein the main drive operates in cycles between a forming stroke that displaces the forming component toward the inner side of the spine region to an extended, forming position and an opposite, retraction stroke that withdraws the forming component to a fully retracted position; and the adjusting drive is operable to adjust the least one additional forming element at any time during a cycle.

10. The device according to claim 1, wherein said at least one additional forming element includes a central and two laterally adjacent forming elements, each having convexly curved surfaces that in part define the profile and vertically contact the spine region during forming; and one independently controllable adjusting drive is provided for vertically adjusting the central forming element and another independently controllable adjusting drive is provided for vertically adjusting the two laterally adjacent elements together.

11. A device for preforming spine regions in planar book cases having a spine region including a pair of joint areas that connect to a pair of case boards, comprising:

a forming component including a base element and at least one additional forming element that is adjustable relative to the base element and together with the base element define a profile of the forming component for preforming the spine region the book case;

a first, main drive for displacing the forming component toward an inner side of the spine region and thereby raising the spine region out of the plane of the book case; and a second, adjusting drive that adjusts said at least one additional forming element independently of the first drive and thereby alters the profile of the forming component;

wherein, the at least one additional forming element includes two forming elements;

the adjusting mechanism includes two independent adjusting drive mechanisms, each operatively connected to one of said two forming elements;

a control unit controls the actuation of each adjusting drive mechanism; whereby the control unit can thereby adjust the respective forming element during any position or motion of the forming component as driven by the main drive.

12. A device for preforming spine regions in planar book cases having a spine region including a pair of joint areas that connect to a pair of case boards, comprising:

a forming component including a base element and one additional forming element that is adjustable relative to the base element and together with the base element define a profile of the forming component for preforming the spine region the book case;

a first, main drive for displacing the forming component toward an inner side of the spine region and thereby raising the spine region out of the plane of the book case; and a second, adjusting drive that adjusts said at least one additional forming element independently of the first drive and thereby alters the profile of the forming component;

wherein the base element and the additional forming element are horizontally spaced apart rails and a respective two adjusting drives are operatively connected to the rails to adjust the horizontal spacing between the rails.

13. The device according to claim 12, wherein each adjusting drive is independently controllable to independently adjust each rail.

* * * * *